US005408392A

United States Patent [19]

Hughes

[11] Patent Number: 5,408,392

[45] Date of Patent: Apr. 18, 1995

[54] LAMP SOCKET FOR USE IN REFRIGERATOR

[75] Inventor: Edward L. Hughes, Louisville, Ky.

[73] Assignee: General Electric Company, Louisville, Ky.

[21] Appl. No.: 133,323

[22] Filed: Oct. 8, 1993

[51] Int. Cl.[6] ..... F25D 27/00

[52] U.S. Cl. ..... 362/92; 362/226; 362/396; 439/340

[58] Field of Search ..... 439/339, 340, 664, 665, 439/666, 667; 362/92, 94, 95, 126, 226, 396; 99/341; 432/32

[56] References Cited

U.S. PATENT DOCUMENTS

| | | | |
|---|---|---|---|
| 771,916 | 10/1904 | Moffitt | 439/665 |
| 1,789,582 | 1/1931 | Eckstein | 439/339 |
| 2,229,403 | 1/1941 | Benander | 439/340 |
| 2,620,374 | 12/1952 | Benander | 439/340 |
| 2,695,393 | 11/1954 | Tiscione | 439/340 |
| 2,721,985 | 10/1955 | Gilbert | 439/340 |
| 3,783,435 | 1/1974 | Fisher | 439/340 |
| 4,441,782 | 4/1984 | Kneer | 439/667 |
| 5,176,532 | 1/1993 | Herzog et al. | 439/340 |

*Primary Examiner*—Ira S. Lazarus
*Assistant Examiner*—Alan B. Cariaso
*Attorney, Agent, or Firm*—H. Neil Houser

[57] ABSTRACT

A socket for a refrigerator lamp has a body with a chamber to receive the base of the lamp. The chamber side wall is threaded to engage the lamp base threads. An inclined ramp between the threads and the bottom of the chamber engages the lamp base to provide a positive stop when the base is completely in the socket. A first terminal in the socket has a contact portion radially inside the ramp to engage the lamp base just before the base engages the ramp. A second terminal in the socket has a resilient arm to engage a contact in the distal end of the base just before the base engages the ramp. A tab in the bottom of the chamber closely underlies the resilient finger to prevent permanent deformation of the finger. An enclosure wall extends out from the open end of the chamber and closely surrounds a lamp inserted in the socket to assure that the user will not touch the lamp base while either electrical terminal engages the base. The socket fits in an opening in the refrigerator liner and includes a flange engaging the liner around the opening. An arm extends from the socket body and engages the opposite side of the liner than the flange. The arm and a mating opening in the flange are so narrow that only a tool narrower than a person's finger can be used to release the socket.

10 Claims, 2 Drawing Sheets

LAMP SOCKET FOR USE IN REFRIGERATOR

BACKGROUND OF THE INVENTION

A lamp normally is mounted in each compartment of refrigerators to provide illumination for the user. Typically, the lamp is mounted on either the rear wall or the rear portion of a side wall of the liner. For the sake of simplicity such lamps are normally mounted directly in openings in the liners. Since refrigerators typically incorporate a foamed-in-place insulation between the liner and the outer cabinet, it is essentially impossible to get access to the rear of the lamp socket while it is installed, in the event repairs or replacement is needed. Therefore, it is customary to make the socket removable from the liner. To avoid inappropriate removal of the socket it is advantageous that a tool be required, rather than it being possible for someone to remove the socket merely by using only their hands.

Many sockets for use in refrigerators are molded of a plastic material. The chamber to receive the lamp base has threads molded into its side wall and an electrical terminal extends along the side wall, in a discontinuity in the threads, and engages the threaded sleeve of the lamp base. This provides one electrical connection for the lamp. There is a button contact in the end of the lamp base and a resilient terminal in the bottom of the chamber engages the button contact to provide the other electrical connection for the lamp. The interior of refrigerators are damp, particularly the fresh food compartment. Thus a typical socket design is not optimal for a number of reasons. For example, the terminal arrangement and configuration of the body of the socket may not provide optimum assurance that someone changing the lamp will not be able to contact the sleeve at a time when either electrical connection for the lamp is complete. In addition, the lamp base often "bottoms out" on the inner end of the socket chamber. This can result in the second or bottom socket terminal becoming permanently deformed. This situation can lead to erratic operation of the lamp.

It is an object of this invention to provide an improved lamp socket which mounts in a refrigerator liner and is not removable by use of human fingers alone.

It is another object of this invention to provide an improved lamp socket which assures that a user's fingers will not be in contact with the contact sleeve of the lamp whenever either electrical connection for the lamp is completed.

It is another object of this invention to provide an improved lamp socket in which the lamp is positioned in a fully seated position removed from the bottom of the socket chamber.

It is yet another object of this invention to provide such an improved lamp socket in which the electrical connections for the lamp are completed just before the lamp base reaches its fully seated position in the socket.

SUMMARY OF THE INVENTION

In accordance with one embodiment of the invention a lamp socket includes a body with a hollow, cylindrical chamber having an open and a closed end. The chamber inner wall has a threaded section to co-operate with the threaded section on the lamp base contact sleeve. The chamber also includes an inwardly inclined ramp positioned to engage the lamp base shoulder when the base is fully received or seated in the chamber. A first electrical terminal in the chamber is positioned radially inward of the ramp to engage the lamp base sleeve just before the lamp base shoulder engages the ramp. A second electrical terminal includes a resilient finger projecting generally perpendicular to the longitudinal axis of the chamber adjacent its closed end and engages the contact at the distal end of the lamp base just before the lamp base shoulder reaches the chamber ramp.

According to another aspect of this invention, the socket base fits in an opening in the liner of a refrigerator and includes a flange extending around the base and engaging the liner. A resilient arm projects from the base and releasably engages the opposite side of the liner than the flange. The arm and a corresponding opening in the flange are sufficiently narrow to permit a narrow tool to be used to release the arm from engagement while preventing a person's finger from releasing the arm.

DETAILED DESCRIPTION OF PREFERRED EMBODIMENT

Figure 1:
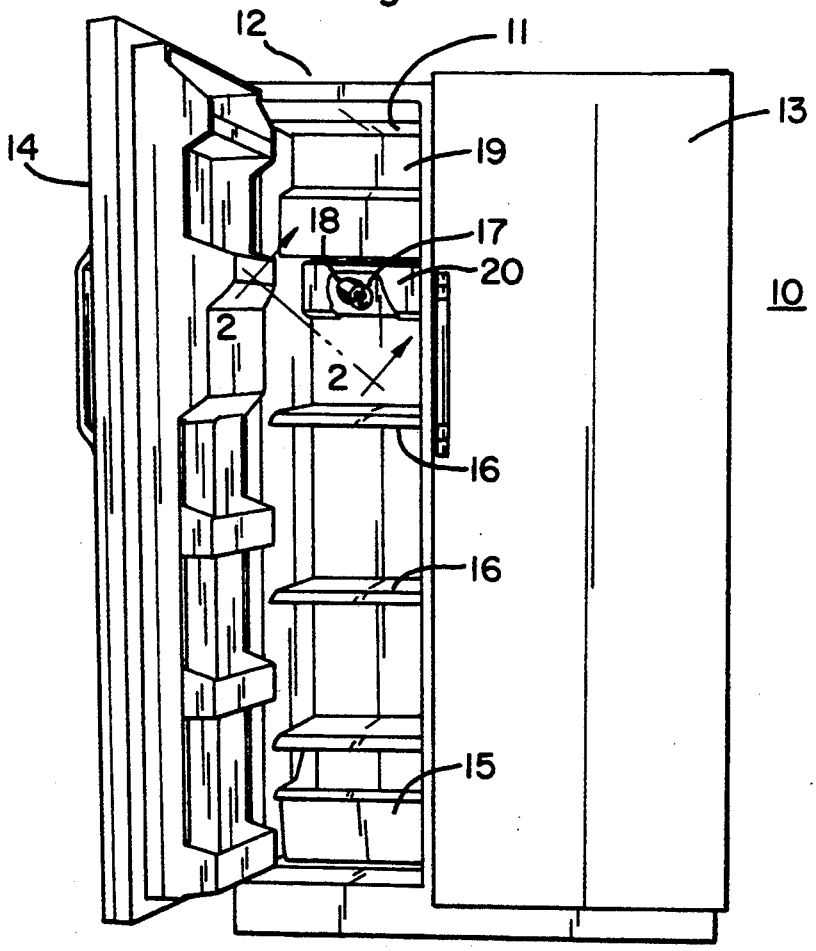
FIG. 1 is a simplified front elevation view of a side-by-side refrigerator, with the freezer door open to show a lamp socket in accordance with one embodiment of the present invention.
Figure 2:
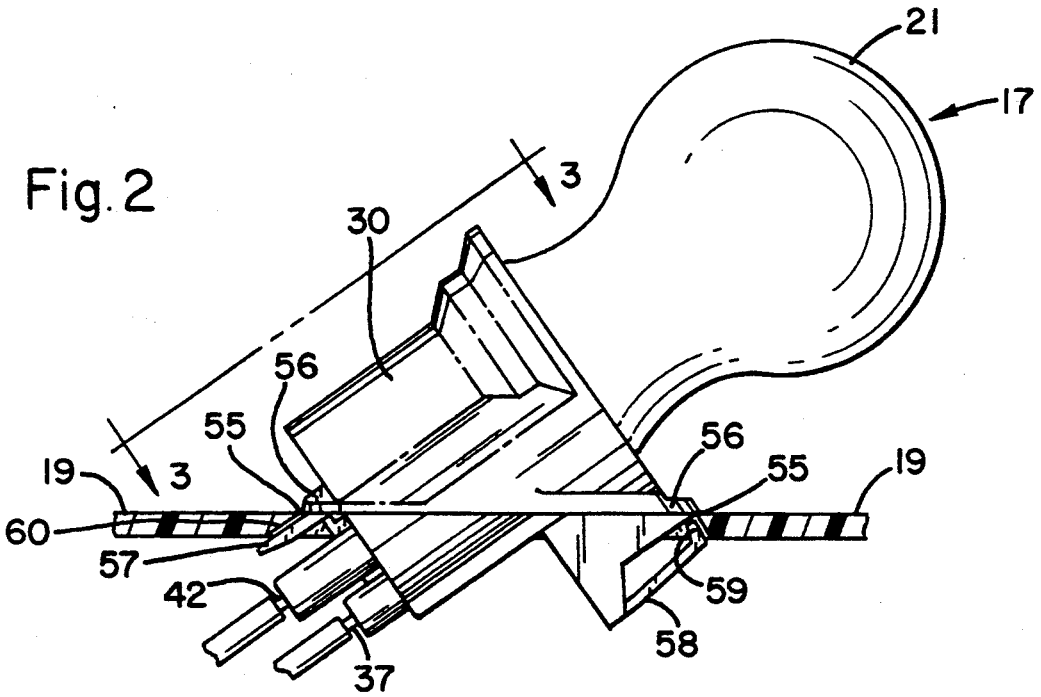
FIG. 2 is a fragmentary cross-sectional view of a portion of the refrigerator liner including the lamp and lamp socket, as seen along line 2—2 in FIG. 1.

Referring now particularly to FIG. 1, there is illustrated a side-by-side refrigerator 10 in which a fresh food compartment, not shown, and a freezer compartment 11 are arranged in a side-by-side configuration in a cabinet 12. Each of the compartments has a front access opening normally closed by doors 13, 14 respectively. Typically, drawers, such as 15, and shelves 16 are provided in each of the compartments to facilitate storage of items to be cooled or frozen.

In order to enhance the visibility, each of the compartments is provided with an electric light or lamp that is automatically energized whenever the door to that compartment is open. As seen in FIG. 1, a lamp 17 is mounted in a lamp socket 18 that, in turn, is mounted to the liner 19 of the freezer compartment. The socket provides both physical support for and electric energy to the lamp. A shield or diffuser 20 is mounted over the lamp to diffuse or spread the light from the lamp evenly throughout the freezer compartment. A portion of the shield 20 has been broken away to show the lamp 17 and socket 18.

The lamp 17 includes a glass bulb or envelope 21 that houses a filament, not shown, that glows when supplied with electric power. The neck or lower end of the envelope is mounted in a base including a generally cylindrical metallic contact sleeve 23 that has its main section threaded, that is provided with alternate lands 24 and grooves 25. The end section 26 of the sleeve 23 slants radially inward and joins an insulator 27, which also slants radially inward. The section 26 and insulator 27 form an inwardly inclined or tapered shoulder for the lamp base. A button like electrical contact 28 is provided at the distal end of the insulator 27 and is electrically separated from sleeve 23 by the insulator. As will be explained in more detail hereafter, the sleeve 23 provides a first electrical connection for the filament and the contact 28 provides a second electrical connection.

Figure 4:
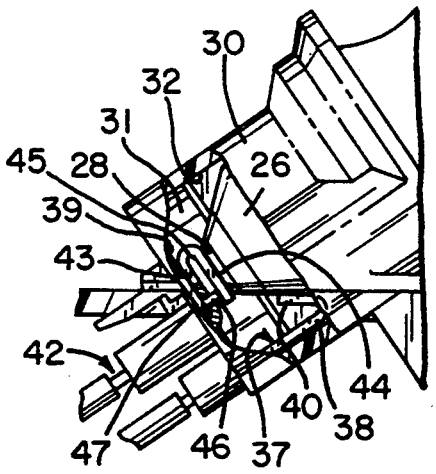
FIG. 4 is a fragmentary cross-section view as seen along line 4—4 in FIG. 3.
Figure 3:
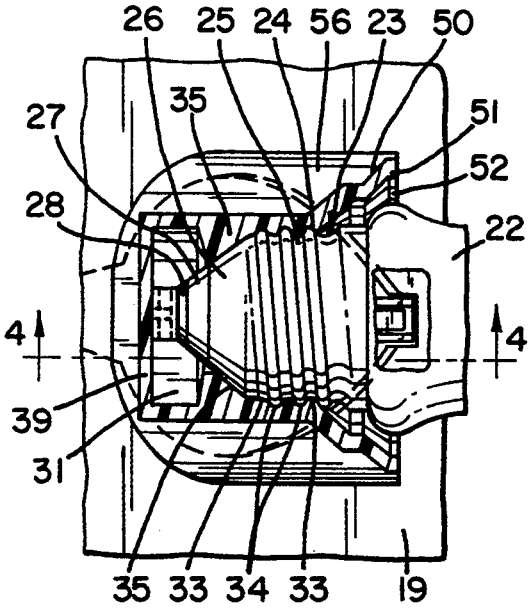
FIG. 3 is a fragmentary cross-section view as seen along line 3—3 in FIG.2.
Figure 5:
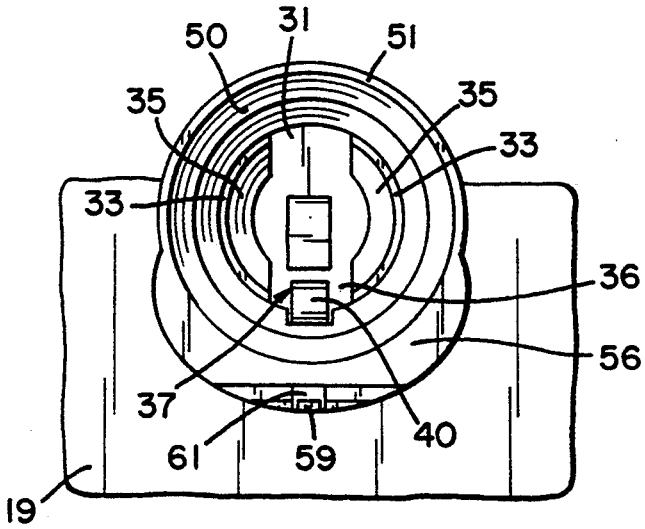
FIG. 5 is an elevation view looking into the open end of the socket of FIGS. 1–4, with the lamp removed.

Referring now more particularly to FIGS. 3–5, the socket 18 conveniently may be formed of a suitable molded plastic material such as glass filled Nylon. The socket includes a body 30 defining a central, elongated cylindrical chamber 31 to receive and support the base of the lamp 17. To that end, the generally cylindrical internal side wall 32 of the chamber is threaded, that is provided with lands 33 and grooves 34, complimentary to the lands and grooves 24, 25 of the sleeve 23. An inwardly inclined ramp 35 is positioned at the inner end of the threaded portion of wall 32. The ramp 35 mirrors the inclined lamp base shoulder formed by the end section 26 of sleeve 23 and the insulator 27. The lamp 17 is mounted in the socket 18 by screwing the threaded section of sleeve 23 into the threaded section of chamber wall 32 until the lamp base shoulder rests against the chamber ramp 35.

Referring to FIG. 5, it will be seen that the lands 33 on ramp 35 are interrupted, that is a small arcuate section at the top and bottom of the body 30 is omitted. These discontinuities enhance the molding process. In addition, viewing FIGS. 4–5, one electrical terminal of the socket is partly mounted in the lower discontinuity. More particularly, the terminal 37 has an elongated body 38 which extends into the chamber through the chamber bottom wall 39 and lies adjacent the lower portion of the chamber side wall. The inner end of the terminal 37 is reverse bent to form a tang 40 that extend backward along the body 38 at an acute included angle. Thus the tang 40 is positioned within the bottom discontinuity 36 and has a normal or rest position slightly radially inward of the adjacent portion of ramp 35. When the lamp is screwed into the socket, tang 40 comes into contact or engagement with the inclined end section 26 of the lamp base sleeve 23 just before the sleeve engages or bottoms out on the ramp 35. The engagement between tang 40 and sleeve end 26 provides a first electrical connection for the lamp.

A second terminal 42 extends through the central portion of chamber bottom wall 39 and is formed with a returned bent inner portion. That is, the inner portion of terminal 42 includes fingers 43 and 44 joined by a U-shaped section or bend 45. The finger 43 is positioned against the bottom wall 39 while the finger 44 overlies finger 43 in slightly spaced apart relationship thereto, providing finger 44 with a degree of resiliency. The fingers extend generally parallel to the bottom wall 39 and perpendicular to the longitudinal axis of the chamber 31. When the lamp 17 is screwed into the socket 18, the button contact 28 engages finger 44 just before the lamp base shoulder bottoms out on ramp 35. This provides the lamp 17 with its second electrical connection. The resiliency of finger 44 absorbs the slight additional movement of contact 28. A tab 46 projects from the inside of bottom wall 39, extends through an opening in finger 43 and terminates just short of the facing side of finger 44, when finger 44 is in its rest position. The tab 46 engages finger 44 if contact 28 depresses it too much and assures that finger 44 is not permanently deformed. It will be understood that permanent deformation of finger 44 could cause subsequent inoperability of the socket 18.

Referring now particularly to FIG. 3, it will be seen that, at the end of chamber 31 opposite bottom wall 39, the socket body 30 is formed with an enclosure wall 50 that extends around and projects outwardly from chamber 31. The wall 50 includes a distal edge 51 defining an opening 52 through which the lamp is inserted into the chamber 31. The shape and diameter of wall 50 is such that the wall closely overlaps a lamp being installed in the socket. More particularly there is insufficient space for a person to have his or her finger between the wall and the bulb 21 as the lamp 17 is screwed into the socket. In addition, the distance between the adjacent (outer) edge of lands and grooves 33, 34 and the distal edge 51 is greater than the length of the threaded section of sleeve 23. This assures that a person cannot have his/her finger in contact with sleeve 23 at the same time either electrical connection for the lamp is complete; that is when either tang 40 engages sleeve end section 26 or resilient finger 44 engages button contact 28.

As is generally indicated in FIG. 1, the socket 18 is mounted to the liner 19. Referring now more particularly to FIGS. 2–5, the body 30 of the socket fits closely within an opening 55 in the liner 19. The socket includes a flange 56 which extends completely around the outside of body 30 and engages the liner around the periphery of the opening 55. A tab 57 projects from the bottom of the body 30 and engages the underside of the liner 19. A resilient arm 58 projects outward of the body adjacent the open end 52 of the chamber and in spaced relationship to the flange 56. The arm includes a return bent end portion 59 that engages the underside of the liner, that is the side opposite the flange 56. Conveniently the underside of the liner around opening 55 is beveled, as shown at 60, and both the tab 57 and end 59 of arm 58 engage the beveled portion. This assists in inserting and removing socket 18 from liner 19.

As best seen in FIG. 5, the arm 58, or at least the return bent end portion 59, is rather narrow; preferably less than about one quarter inch wide. Also the flange 56 includes a slot or recess 61 in register with the end 59 and the slot 61 is rather narrow, being just slightly wider than the end 59. With this arrangement a narrow tool, such as a small screw driver for example, can be inserted through the slot 61 and depress end 59 to free socket 18 for removal from the opening 55 in liner 19. At the same time the end 59 and slot 61 are too narrow for a person to use his/her finger to depress the arm 58.

What is claimed is:

1. A lamp socket, for use with an electric lamp including a base having a cylindrical side wall with a threaded section forming one electrical contact for the lamp, the one electrical contact including an inwardly tapering shoulder extending from the threaded section toward the distal end of the base, and a second electrical contact for the lamp formed at the distal end of the base; said lamp socket including:

a body including a hollow cylindrical chamber with an open end and a closed end joined by an inner wall including an intermediate threaded portion to engage the threaded section of the lamp base as the lamp base is received in said chamber;

an inwardly inclined ramp positioned within said chamber between said threaded portion and said closed end to engage the lamp base shoulder as the lamp base becomes fully received in said chamber;

a first electrical terminal extending longitudinally along a portion of said inner wall from said closed end and including an inclined contact portion positioned to engage the lamp base shoulder just before the lamp base becomes fully received in said chamber;

a second electrical terminal mounted adjacent said closed end of said hollow chamber and including a resilient finger extending generally perpendicular to the longitudinal axis of said chamber and positioned to engage the second lamp contact just before the lamp base becomes fully received in said chamber.

2. A lamp socket as set forth in claim 1, wherein: said inclined ramp is discontinuous and said first electrical terminal extends along said inner wall into said discontinuity and is bent to form said inclined portion positioned radially inward of said ramp to engage the lamp base shoulder just before the lamp base becomes fully received in said chamber.

3. A lamp socket as set forth in claim 1, wherein: said second electrical terminal includes a pair of overlying fingers joined by a return bent section, one of said fingers closely overlying said closed end of said chamber while the other of said fingers constitutes said resilient finger positioned to engage the second lamp contact, and a tab projecting from said closed end of said chamber and terminating adjacent to said resilient finger to prevent permanent deformation of said resilient finger by said lamp base.

4. A lamp socket as set forth in claim 3, wherein: said one of said fingers includes an opening therethrough and said tab extends through said opening and terminates adjacent to the facing side of said resilient finger.

5. A lamp socket as set forth in claim 1, wherein: said body includes an enclosure wall extending outwardly from the open end of said chamber and configured to closely surround the lamp, said wall including a distal rim defining an opening to receive the lamp; the distance from the adjacent end of said threaded portion of said inner wall to said distal rim being sufficiently longer than the length of said threaded portion to assure that a user's fingers do not contact the threaded section of the lamp base when either lamp electrical contact engages the corresponding lamp socket electrical terminal.

6. A lamp socket for use in mounting, in an opening in a refrigerator liner, an electric lamp including a base having a cylindrical side wall with a threaded section forming one electrical contact for the lamp, the one electrical contact including a shoulder positioned radially inward of the threaded section and longitudinally between the threaded section and the distal end of the base, and a second electrical contact for the lamp formed at the distal end of the base,; said lamp socket including:

an elongated body having an outer shape to closely fit within the opening in the liner and a flange extending around the outside of said body to overlie the liner adjacent the opening therein;

a resilient arm projecting from said body and spaced from said flange to engage the side of the liner opposite said flange;

said arm being less than about one quarter inch wide and said flange defining an opening therethrough slightly wider than the width of said arm to permit access to said arm by a tool less than about one quarter inch wide for releasing said arm from engagement with the liner;

said body including a hollow cylindrical chamber with an open end and a closed end joined by an inner wall including a threaded portion spaced from each end of said chamber to engage the threaded portion of the lamp base as the lamp base is received in said chamber;

a ramp positioned within said chamber between said threaded portion and said closed end to engage the lamp base shoulder as the lamp base becomes fully received in said chamber;

a first electrical terminal positioned within said chamber to engage the lamp base shoulder just before the lamp base becomes fully received in said chamber;

a second electrical terminal mounted adjacent said closed end of said hollow chamber and positioned to engage the second lamp contact just before said lamp base becomes fully received in said chamber.

7. A lamp socket as set forth in claim 1, wherein: said ramp is discontinuous and said first electrical terminal extends into said discontinuity and is bent to include a tang portion projecting beyond said ramp to engage the lamp base shoulder just before the lamp base becomes fully received in said chamber.

8. A lamp socket as set forth in claim 6, wherein said second electrical terminal includes a pair of overlying fingers joined by a return bent section, one of said fingers closely overlying said closed end of said chamber while the other of said fingers constitutes said resilient finger positioned to engage the second lamp contact, and a tab projecting from said closed end of said chamber and terminating adjacent to said resilient finger to prevent permanent deformation of said resilient finger by said lamp base.

9. A lamp socket as set forth in claim 8, wherein: said first finger includes an opening therethrough and said tab extends through said opening and terminates adjacent to the facing side of said resilient finger.

10. A lamp socket as set forth in claim 6, wherein: said body includes an enclosure wall extending outwardly from the open end of said chamber and configured to closely surround the lamp, said wall including a distal rim defining an opening to receive the lamp; the distance from the adjacent end of said threaded portion of said inner wall to said distal rim being sufficiently longer than the length of said threaded portion to assure that a user's fingers do not contact the threaded section of the lamp base when either lamp electrical contact engages the corresponding lamp socket electrical terminal.

* * * * *